United States Patent [19]

Burt, Jr.

[11] Patent Number: 5,006,226

[45] Date of Patent: Apr. 9, 1991

[54] FLUIDIZED, DRY BED, ORE CONCENTRATOR

[76] Inventor: Leo O. Burt, Jr., P.O. Box 567, Wickenburg, Ariz. 85358

[21] Appl. No.: 115,972

[22] Filed: Nov. 2, 1987

[51] Int. Cl.[5] ..... B07B 9/00

[52] U.S. Cl. ..... 209/19; 209/20; 209/130; 209/131; 209/138; 209/147; 209/467; 209/470

[58] Field of Search ..... 209/12, 19, 20, 127.1, 209/131, 138, 133, 139.1, 147, 466–468, 470, 469, 130, 502, 127.2, 3, 11

[56] References Cited

U.S. PATENT DOCUMENTS

| | | | |
|---|---|---|---|
| 2,116,613 | 5/1938 | Bedford | 209/131 |
| 2,294,086 | 8/1942 | Hinds et al. | 209/147 X |
| 2,310,894 | 2/1943 | Brusset | 209/467 |
| 3,471,016 | 10/1969 | Eveson et al. | 209/470 |
| 4,279,740 | 7/1981 | Isogaya | 209/12 |
| 4,451,357 | 5/1984 | LaVigne | 209/131 |

*Primary Examiner*—H. Grant Skaggs
*Assistant Examiner*—David H. Bollinger
*Attorney, Agent, or Firm*—James F. Duffy

[57] ABSTRACT

A fluidized, dry bed, ore concentrator in which a uniform air stream is utilized to fluidize ore particles within a region defined in part by two, moving, riffled surfaces. The particles are statically charged to enhance separation of particles within the fluidized mass. The less massive of the like-charged, fluidized particles are drawn off by a first riffled surface and denoted "tailings". The more massive, and valuable, of the particles are drawn off by the second of the two riffled surfaces and denoted as "fines".

26 Claims, 1 Drawing Sheet

FLUIDIZED, DRY BED, ORE CONCENTRATOR

BACKGROUND

1. Field of the Invention

The invention relates to the field of methodology and devices in which desired materials are selectively withdrawn from a mixed accumulation of materials and segregated as a concentrated accretion of said selectedly withdrawn material.

In particular, the invention relates to means and method whereby a dry mixture of ore fines and tailings are fluidized and the fines withdrawn from the fluidized mix to yield a concentrated accumulation of fines.

2. Prior Art

The prior art known to the inventor neither anticipates nor makes obvious the present invention. As an example of the prior art known in the field of segregating materials by variations in the weight (mass) of the materials, the inventor herein cites the U.S. patents of Hinds et al, issued Aug. 25, 1942 as U.S. Pat. No 2,294,086; and of Isogaya, issued July 21, 1981 as U.S. Pat No 4,279,740. Both use air to separate materials by their differing masses; while Isogaya also employs electrostatic attraction to draw light weight materials to a collection drum.

The Hinds et al patent issued for a PNEUMATIC SEPARATING APPARATUS. The materials to be separated were two distinctly different materials one of which was relatively light with respect to the other. The materials to be separated were deposited on a continuous (sometimes referred to as "endless") belt. The upper surface of this first continuous belt passed a distance beneath and parallel to the under surface of a second continuous belt. Both surfaces preferably travel in the same direction and are of an open mesh to allow the passage of air therethrough. When air is passed through the two belts and the mass of materials, the lighter (less massive) of the two materials is transported upward and deposited against the lower surface of the second continuous belt. The heavier, or more massive, material remains on the upper surface of the lower continuous belt. The two materials are thus effectively segregated and means for their separate collection are readily conceived.

The Isogaya patent issued for a LIGHT-MATERIAL SEGRAGATING METHOD AND APPARATUS. Isogaya is faced with the same problem as Hinds et al: separating relatively very light material from a heavy material. As with Hinds et al, the materials to be separated are deposited onto the upper surface of a continuous belt through which a stream of air is passed. However, instead of employing a second continuous belt, Isogaya uses an array of rollers above the material. Each roller is slightly spaced apart from its adjacent roller so the air passing through the material on the continuous belt will move upward and through the spaces between rollers, hopefully transporting lightweight material through those spaces as well.

To enhance the transporting effect of the moving air, Isogaya creates a vacuum above the array of rollers. As a further enhancement to the separation of materials from the mass, the rollers are electrostatically charged. Materials, such as powdered substances and hair, are readily attracted to the charged surfaces of the rollers. To prevent these substances from accumulating on the roller surfaces, the rollers are caused to rotate whereby the adhering material is drawn into the air stream moving through the spaces between the rollers and drawn from the roller surface toward the vacuum source.

Neither Hinds et al nor Isogaya attempt to percolate air through the mass of materials to be separated such that the mass becomes fluidized and particles of various weights migrate to their own segregated strata within the fluid mass. Neither of them teach that the particles of the fluidized mass may be further segregated by electrostatically inducing a charge on the particles themselves. Neither teach that the mass may be fluidized between oppositely traveling surfaces of adjacent moving belts, which opposed travel aids in accumulating selected, segregated material from the fluid mass. Nor do Hinds et al and Isogaya teach that variations in the speed of travel of the oppositely moving belts may be utilized to enhance the selective accumulation of materials from the fluid mass. These latter features are taught here by the instant inventor.

SUMMARY OF THE INVENTION

The invention may be summarized as a fluidized, dry bed, concentrator comprising means for fluidizing a mass of dry particulate material so as to physically segregate within the fluidized mass relatively heavy particulates from relatively light particulates; and means coupled to the fluidizing means for withdrawing from the fluidized mass selected particulate matter so physically segregated.

The concentrator further comprises means, coupled to the fluidizing means, for electrostatically charging the particulate material in the fluidized mass so as to further enhance the physical segregation of particulates within the mass. The means for electrostatically charging the particulate matter comprises means, coupled to the fluidizing means, for percolating electrostatically charged air as a fluidizing medium through the mass of dry particulate matter.

The means for withdrawing selected particulate matter is disclosed as comprising first extraction means coupled to a region of the fluidized mass in which relatively light particulate matter is segregated for extracting from the fluidized mass the relatively light particulate matter; and second extraction means coupled to a region of the fluidized mass in which relatively heavy particulate matter is segregated for extracting from the fluidized mass the relatively heavy particulate matter.

The means for withdrawing selected particulate matter may be otherwise summarized as comprising a first withdrawal belt: a continuous driven belt of a structure which permits air flow therethrough, and having a first surface defining the upper bounds of a fluidizing air plenum. There is also a second withdrawal belt: a continuous driven belt of a structure which permits air flow therethrough, and having a second surface defining the lower bounds of a fluidizing air plenum. Coupled to the belts are means for driving the first and the second withdrawal belts such that relatively light particulates are drawn off from the upper region of the fluidized mass by the first surface of the first belt, and relatively heavy particulates are drawn off from the lower regions of the fluidized mass by the second surface of the second belt.

As will be seen in the disclosure, the first withdrawal belt and the second withdrawal belt are each provided with riffles, coupled individually to the first and the second surfaces thereof and extending selected distances into the fluidizing air plenum defined in part by the first and the second belt surfaces. The means for driving the first and the second withdrawal belts further comprises means for driving each of the belts independently at selected variable speeds and directions.

Also taught herein is a method for fluidizing and concentrating a mass of dry particulate material comprising the steps of:

a. using two driven, air permeable, continuous, riffle belts to define, between adjacent surfaces of the belts, an upper and a lower region of an air plenum;
b. introducing a mass of dry particulate matter into the air plenum so defined;
c. percolating air through the dry particulate matter within the air plenum so as to fluidize the dry particulate matter and cause a stratification of particulate matter therein in accord with the mass (weight) of the particles comprising the dry particulate matter, the heavier particles stratifying in the lower regions of the fluidized material;
d. using a first of the riffle belts to draw off particulate material stratified in the upper region of the air plenum; and
e. using the second of the riffle belts to draw off particulate material stratified in the lower region of the air plenum;

whereby separate concentrations of heavy particulate matter and lighter (less massive) particulate matter are accumulated.

The potential for including the following steps in the method is also disclosed:

the step of electrostatically charging the particulate matter to enhance segregation and stratification of particles within the air plenum;

the step of electrostatically charging the particulate matter comprises the step of electrostatically charging the percolating air used to fliudize the particulate material;

the step of electrostatically charging the percolating air comprises the step of first passing the air through a charge-transfer material, such as a nylon mesh.

The invention also claims all products produced by practice of the methodology taught herein.

DETAILED DESCRIPTION OF THE INVENTION

Figure 1:
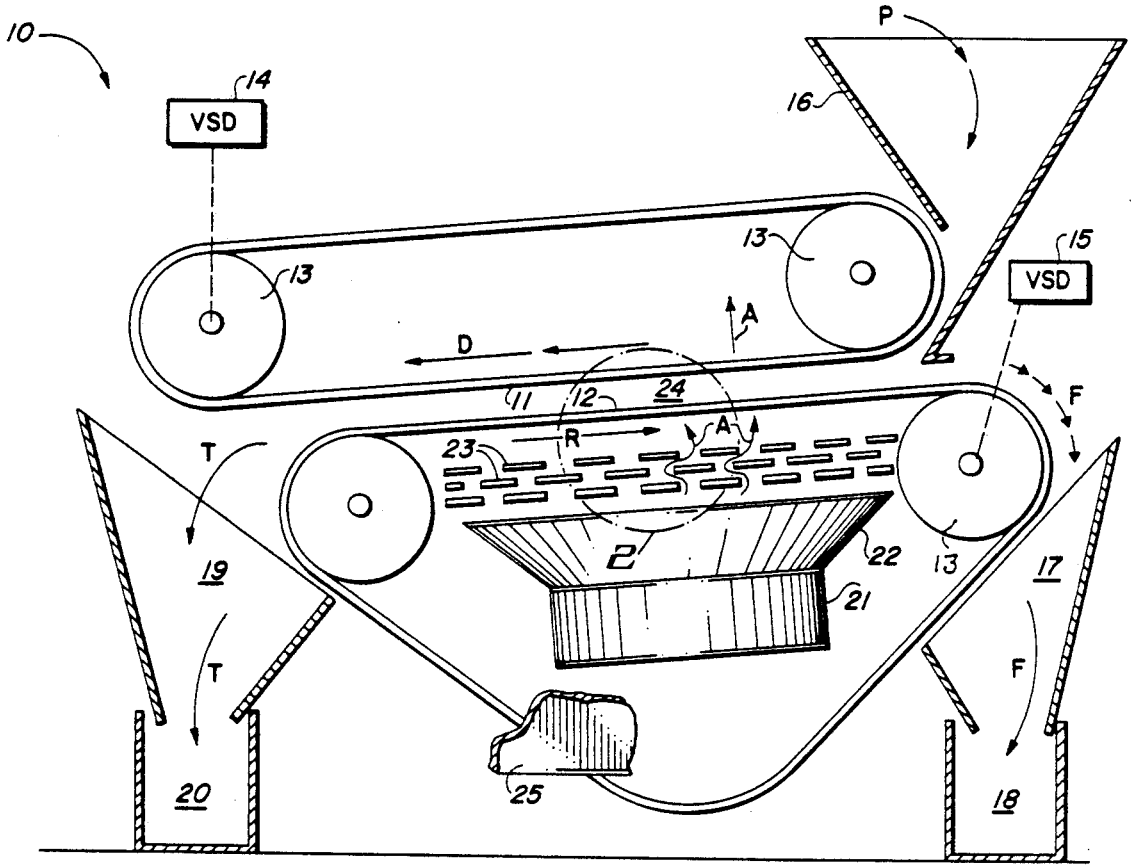
FIG. 1 is a mechanical schematic representation of the invention.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention partains.

The invention 10 is a fluidized, dry bed, ore concentrator as indicated schematically in FIG. 1. The invention is comprised of a rapidly moving, continuous drag belt 11. Drag belt 11 travels, for example, at a linear velocity of 70 to 75 feet per minute. There is also a slow moving, continuous riffle belt 12. Riffle belt 12 travels, for example, at a linear velocity of 1 to 2 inches per minute. Air can pass through both belts 11 and 12. Their structure may be comprised, for example, of an open mesh.

Belts 11 and 12 preferably travel in opposite directions. Direction arrow D indicates the direction of motion of drag belt 11, while direction arrow R indicates that of riffle belt 12. The purpose of the opposed motion of the two belts is to permit the convenient segregation and accumulation of ore tailings and fines. This purpose is further enhanced by driving each of belts 11 and 12 independently at selected, variable speeds.

Belts 11 and 12 are sprocket driven, open mesh belts, for example, woven wire steel belts. Each belt is independently driven by a variable speed drive (VSD). VSD 14 drives a sprocket 13 which engages with drag belt 11 and drives it rapidly in the direction of arrow D. VSD 15 drives another sprocket 13 which is engaged with riffle belt 12 to drive it in the direction of arrow R.

The ore particles are placed, arrows P, in input hopper 16 wherein they impinge on belt 11 and are rapidly drawn from hopper 16 into region 24 between belts 11 and 12. In a manner to be described, the ore tailings are directed toward and injected into, arrows T, tailings output hopper 19 from whence they accumulate in container 20. Also to be described is the manner in which the ore fines are segregated and directed, arrows F, toward and into fines output hopper 17 to accumulate in container 18. More general characteristics of the invention will be disclosed before the details of the segregation and accumulation of fines and tailings are discussed.

An air flow of 10,000 to 30,000 cubic feet per minute, for example, is created by fan 21 and directed by ducting 22 through baffle plates 23. Baffle plates 23 cause a uniform flow of air to pass through region 24, traversing the open mesh of both belts 11 and 12 in transit. A uniform air flow is desired in region 24 so that ore particulates entering into region 24 will become fluidized. With a uniform stream of air flowing in the direction of arrows A, ore particulates entering region 24 will be buoyantly uplifted and establish themselves in strata, within the mass of ore particulates, which strata are related to the mass of each individual particle. Such a stratified mass of buoyant particles is known in the art as a fluidized bed.

For best efficiency in establishing a fluidized bed of ore particles in region 24, the air flow, arrows A, must be restricted to a desired flow path through belts 11 and 12 and region 24 with minimal deviation around, rather than through, belts 11 and 12. To this end, the air flow is further ducted by enclosing the sides of concentrator 10, as indicated schematically by sidewall section 25. This arrangement, in cooperation with ducting 22, limits any tangential air flow around region 24.

Figure 2:
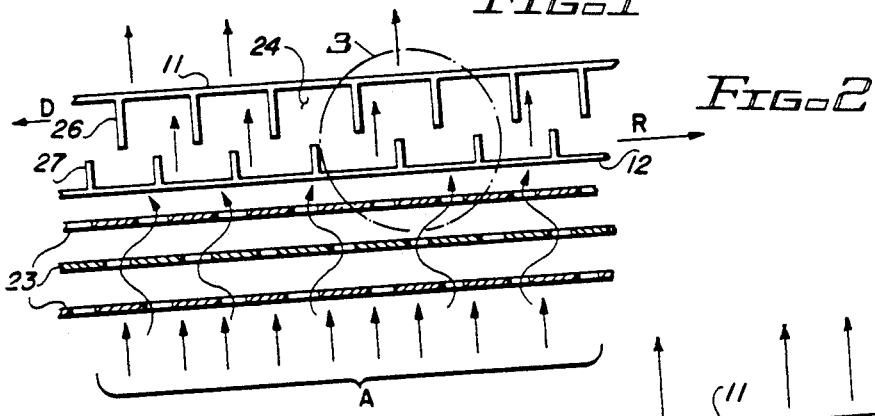
FIG. 2 is an enlarged detail of circled area 2 of FIG. 1.

An enlarged detail of the invention in the vicinity of region 24 is illustrated in FIG. 2. The dispersing effect of baffle plates 23 on air flow A is seen. The greater detail discloses that riffle belt 12 carries a multiplicity of relatively short riffle plates 27 through region 24 as it makes its own relatively slow passage therethrough. Also to be noted is the fact that drag belt 11 carries a multiplicy of relatively long riffle plates or finger-like extensions 26 through region 24 as belt 11 moves on its own relatively rapid way. By way of example and not of limitation, riffles 26 on drag belt 11 may extend about one and one-half inches into region 24; and, riffles 27 on riffle belt 12 may extend about one-half to three-quarters of an inch from belt 12 into region 24. The free extremities of riffles 26 and 27 pass very close to each other. Indeed no adverse effects on the performance of the invention have been noted when the extremities of riffles 26 and 27 touch in passing.

Both belts 11 and 12 may be generically denoted as riffle belts. Denoting belt 11 as a drag belt was done to aid the disclosure. It is the rapid movement of riffles 26 on drag belt 11 that draws the ore particulates, arrows P, from hopper 16 and injects the ore into region 24 to be there fluidized by the air flowing therethrough, arrows A. This fluidization of the ore is seen best in FIG. 3.

Figure 3:
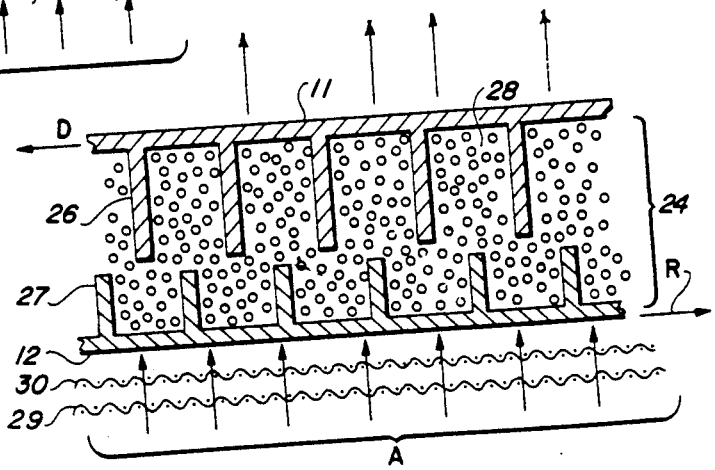
FIG. 3 is a further enlargement of the circled area 3 in FIG. 2.

FIG. 3 represents an enlargement of encircled region 3 of FIG. 2. Here, within region 24 has been established a fliudized bed of ore 28. As is the usual practice with those skilled in the art, ore particles 28 have been screened prior to being injected into input hopper 16. Thus, each of the ore particles is generally of a uniform size relative to all other particles within the fluidized ore bed in region 24. Since the particles of ore 28 are of generally uniform size, the individual particles will establish themselves in strata in the fluidized bed as determined by the mass of that particular particle. The more massive particles will remain in closer proximity to the surface of riffle belt 12 than will the less massive particles which, under the fluidizing effect of air flow A, will buoyantly rise toward the surface of drag belt 11.

The more valuable portion of any ore is denoted as the fines; the less valued portion as the tailings. Usually the fines constitute the most massive particulate matter within the ore. And, as is readily understood, the fines make up only a relatively small portion of the total quantity of ore processed. It is that small but relatively valuable portion of the ore that stratifies near the surface of riffle belt 12 that is to be conveyed to fines output hopper 17 for accumulation in container 18.

The relatively long riffles of drag belt 11 move rapidly through region 24 to drag the lighter, less massive, particles of ore 28 to tailings output hopper 19 from whence the tailings T are accumulated in container 20. The tailings within the ore are rapidly depleted since belt 11 moves at a relatively high linear velocity and because the length of riffles 26 extend well down into the fluidized bed of ore 28 in that portion of region 24 in which the less massive particles of ore 28 stratify.

The fines stratify within the regions defined by riffles 27. These are relatively short riffles, with respect to the length of riffles 26, and the ore particulates moved by them represents a smaller portion of ore 28 fluidized within region 24 than is moved by riffles 26. This smaller portion is also that portion of ore 28 which contains the ore particles having the greatest mass. In addition, the tendency for the most massive particles to be highly concentrated within riffles 27 is enhanced by the fact that belt 12 moves at a slow linear velocity which means that ore within riffles 27 will be subjected to the fluidizing, buoyant effect of air flow A for a longer period of time then ore entrained within riffles 26 on the fast moving drag belt 11.

An opportunity exists for further separating and segregating ore particles one from the other. If the ore particles can be statically charged, the particles will tend to be repelled by each other. When like-charged particles are fluidized, the fluidized mass is less "viscous" than is the case with uncharged particles. Stratification by mass is more pronounced within a fliudized bed of generally uniform particulate size when the particles bear like charges. Whether or not the mechanism is exactly that described is not as important to this disclosure as the fact that statically charging the ore particles improves the concentration of high values within the accumulated fines produced by concentrator 10.

To induce a static charge on the ore particulates within region 24 of the invention, the air flow A is caused to pass through a nylon mesh 29. In the embodiment disclosed here, nylon mesh 29 is emplaced within concentrator 10, between belt 12 and baffle plates 23. All of the fluidizing air A passes through nylon mesh 29 and takes on a static charge. The charged fluidizing air A then passes upward, through the ore particles, to form a fluidized ore bed. Most of the air-borne charge is transferred to the particles of ore 28 of which the fluidized ore bed within region 24 is comprised. With each of the ore particles bearing a like-charge, the beneficial effects noted in the preceding paragraph are derived.

Although all of the particles of ore 28 have been screened to be generally uniform in size, minute particles may be present within the mass of ore and remain present despite several stages of screening. The combined effects of statically charging the ore particles and of fluidizing them tends to free the minute particles of ore from any attachment they may have had to larger particles. The less massive of these particles are rapidly dragged away by riffles 26 on drag belt 11. However, the more massive of these minute particles tend to flow downward, against the flow of fluidizing air A, and to pass through the air passageways provided by the mesh structure of belt 12.

To conveniently recover the fines of minute particulate size, a fine mesh, e.g. 200 mesh, sheet of cotton 30 is suspended between belt 12 and nylon mesh 29. The minute-sized fines are retained by the cotton mesh and recovered therefrom at regular intervals.

What has been disclosed is a fluidized, dry bed, ore concentrator in which a uniform air stream is utilized to fluidize ore particles within a region defined in part by two, moving, riffled surfaces. The particles are statically charged to enhance separation of particles within the fluidized mass. The less massive of the like-charged, fluidized particles are drawn off by a first riffled surface and denoted "tailings". The more massive, and valuable, of the particles are drawn off by the second of the two riffled surfaces and denoted as "fines". In a working prototype of the invention, an effective concentration of high values of 400:1 was achieved.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention.

That which is claimed is:

1. A fluidized, dry bed, concentrator comprising:

means for fluidizing a mass of dry particulate material so as to physically segregate within the fluidized mass relatively heavy particulates from relatively light particulates; and means coupled to the fluidizing means for withdrawing from said fluidized mass selected particulate matter so physically segregated wherein said means for withdrawing selected particulate matter comprises:

first extraction means coupled to a region of said fluidized mass in which relatively light particulate matter is segregated for extracting from said fluidized mass said relatively light particulate matter; and second extraction means coupled to a region of said fluidized mass in which relatively heavy particulate matter is segregated for extracting from said fluidized mass said relatively heavy particulate matter.

2. The concentrator of claim 1 wherein said means for fluidizing said dry mass comprises air percolation means for percolating air through the mass of dry particulate material.

3. The concentrator of claim 2, further comprising means, coupled to said fluidizing means, for electrostatically charging the particulate material in said fluidized mass so as to further enhance said physical segregation of particulates within said mass.

4. The concentrator of claim 3 wherein said means for electrostatically charging said particulate material further comprises means, coupled to said air percolation means, for electrostatically charging the air percolating through the mass of dry particulate matter.

5. The concentrator of claim 1, further comprising means, coupled to said fluidizing means, for electrostatically charging the particulate material in said fluidized mass so as to further enhance said physical segregation of particulates within said mass.

6. The concentrator of claim 5 wherein said means for electrostatically charging said particulate matter comprises means, coupled to said fluidizing means, for percolating electrostatically charged air as a fluidizing medium through said mass of dry particulate matter.

7. The concentrator of claim 6 wherein said means for electrostatically charging said particulate material further comprises means, coupled to said air percolation means, for electrostatically charging the air percolating through the mass of dry particulate matter.

8. A fluidized, dry bed, concentrator comprising:

means for fluidizing a mass of dry particulate material so as to physically segregate within the fluidized mass relatively heavy particulates from relatively light particulates; and means coupled to the fluidized means for withdrawing from said fluidized mass selected particulate matter so physically segregated wherein said means for withdrawing selected particulate matter comprises:

a first withdrawal belt, being a continuous driven belt of a structure which permits air flow therethrough, and having a first surface defining the upper bounds of a fluidizing air plenum;

a second withdrawal belt, being a continuous driven belt of a structure which permits air flow therethrough, and having a second surface defining the lower bounds of a fluidizing air plenum; and means, coupled to said belts, for driving said first and said second withdrawal belts such that relatively light particulates are drawn off from the upper region of the fluidized mass by said first surface of said first belt, and relatively heavy particulates are drawn off from the lower regions of the fluidized mass by said second surface of said second belt.

9. The concentrator of claim 8, further comprising means, coupled to said fluidizing means, for electrostatically charging the particulate material in said fluidized mass so as to further enhance said physical segregation of particulates within said mass.

10. The concentrator of claim 9 wherein said means for electrostatically charging said particulate matter comprises means, coupled to said fluidizing means, for percolating electrostatically charged air as a fluidizing medium through said mass of dry particulate matter.

11. The concentrator of claim 8, further comprising means, coupled to said fluidizing means, for electrostatically charging the particulate material in said fluidized mass so as to further enhance said physical segregation of particulates within said mass.

12. The concentrator of claim 11 wherein said means for fluidizing said dry mass comprises air percolation means for percolating air through the mass of dry particulate material.

13. The concentrator of claim 12 wherein said means for electrostatically charging said particulate material further comprises means, coupled to said air percolation means, for electrostatically charging the air percolating through the mass of dry particulate matter.

14. The concentrator of claim 13 wherein said first withdrawal belt and said second withdrawal belt are each provided with riffles, coupled individually to said first and said second surfaces thereof and extending selected distances into the fluidizing air plenum defined in part by said first and said second belt surfaces.

15. The concentrator of claim 14 wherein said means for driving said first and said second withdrawal belts further comprises means for driving each of said belts independently at selected variable speeds.

16. The concentrator of claim 14 wherein said means for driving said first and said second withdrawal belts further comprises means for driving each of said belts in independently selected relative directions.

17. A method for fluidizing and concentrating a mass of dry particulate material comprising the steps of:

a. using two driven, air permeable, continuous, riffle belts to define, between adjacent surfaces of said belts, an upper and a lower region of an air plenum;

b. introducing a mass of dry particulate matter into the air plenum so defined;

c. percolating air through said dry particulate matter within said air plenum so as to fluidize said dry particulate matter and cause a stratification of particulate matter therein in accord with the mass of the particles comprising the dry particulate matter, the heavier particles stratifying in the lower regions of the fluidized material;

d. using a first of said riffle belts to draw off particulate material stratified in the upper region of said air plenum; and e. using the second of said riffle belts to draw off particulate material stratified in the lower region of said air plenum;

whereby separate concentrations of heavy particulate matter and lighter particulate matter are accumulated.

18. The method of claim 17 further comprising the step of electrostatically charging said particulate matter to enhance segregation and stratification of particles within said air plenum.

19. The method of claim 18 wherein the step of electrostatically charging said particulate matter comprises the step of electrostatically charging the percolating air used to fliudize said particulate material.

20. The method of claim 19 wherein the step of electrostatically charging said percolating air comprises the step of first passing said air through a charge-transfer material.

21. The ore concentrator apparatus for fluidizing and concentrating a mass of dry particulate material produced by practice of the method of claim 20.

22. The ore concentrator apparatus for fluidizing and concentrating a mass of dry particulate material produced by practice of the method of claim 19.

23. The method of claim 18 wherein the step of using two driven riffle belts comprises the further step of driving each of said two belts independently of the other.

24. The ore concentrator apparatus for fluidizing and concentrating a mass of dry particulate material produced by practice of the method of claim 23.

25. The ore concentrator apparatus for fludizing and concentrating a mass of dry particulate material produced by practice of the method of claim 18.

26. The ore concentrator apparatus for fluidizing and concentrating a mass of dry particulate material produced by practice of the method of claim 17.

* * * * *